US005123531A

United States Patent [19]

Beretta

[11] Patent Number: 5,123,531

[45] Date of Patent: Jun. 23, 1992

[54] GOLF CLUB BAG CONFIGURED FOR USE ON A GOLF CART

[76] Inventor: Joseph A. Beretta, 107 Grandview Dr., Lincoln, R.I. 02865

[21] Appl. No.: 736,771

[22] Filed: Jul. 29, 1991

[51] Int. Cl.[5] ..... A63B 55/00; A63B 55/07; A63B 55/08

[52] U.S. Cl. ..... 206/315.3; 206/315.5; 206/315.6; 280/DIG. 5

[58] Field of Search ..... 206/315.3-315.8; 150/159; 280/DIG. 5, DIG. 6

[56] References Cited

U.S. PATENT DOCUMENTS

| | | | |
|---|---|---|---|
| 2,436,688 | 2/1948 | Corbett | 206/315.3 |
| 2,698,040 | 12/1954 | Wilkins | 206/315.5 X |
| 2,707,009 | 4/1955 | Cook | 206/315.5 |
| 2,711,201 | 6/1955 | Hotze | 206/315.5 |
| 2,866,490 | 12/1958 | Thompson | 206/315.6 X |
| 3,259,160 | 7/1966 | Penna | 206/315.5 |
| 4,249,586 | 2/1981 | Setani | 206/315.5 X |
| 4,282,912 | 8/1981 | Brown | 206/315.6 X |
| 4,448,305 | 5/1984 | Sup | 206/315.8 |
| 4,881,638 | 11/1989 | Cho | 206/315.3 |
| 5,038,984 | 8/1991 | Izzo | 206/315.3 X |

FOREIGN PATENT DOCUMENTS

| | | | |
|---|---|---|---|
| 207317 | 11/1923 | United Kingdom | 206/315.5 |
| 714316 | 8/1954 | United Kingdom | 206/315.3 |
| 2204499 | 11/1988 | United Kingdom | 206/315.3 |
| 2234682 | 2/1991 | United Kingdom | 206/315.5 |

*Primary Examiner*—Sue A. Weaver
*Attorney, Agent, or Firm*—Barlow & Barlow, Ltd.

[57] ABSTRACT

Bag for carrying golf clubs on a golf cart, which bag has a tubular main body with a base at the lower end and a cuff at the upper end. The cuff has an upper edge that slopes from the back to the front of the main body. A golf cart strap retainer is located on the back and a handle is located on the front on the upper portion of the main body. Rods extend transversely of the cuff to divide the opening into three sectors for the storage of long woods, short irons, and intermediate sized clubs.

5 Claims, 2 Drawing Sheets

GOLF CLUB BAG CONFIGURED FOR USE ON A GOLF CART

BACKGROUND OF INVENTION

It has been common practice for many years to carry golf clubs in a special bag designed for that purpose; these well-known golf club bags have always been provided with a shoulder strap, so that they could be supported on one shoulder, while the golfer (or his caddy) walked from one spot to another on the golf course.

Two events have taken place during the last few years to change the method of carrying the bag. First of all, it has become more difficult to hire a caddy at a reasonable cost. Secondly, orthopedic physicians have advised that carrying a heavy bag on one side of the body can damage the bones and muscles of the back. In addition, golfers are using more clubs and accessories than they did in past years. All of these factors have encouraged the use of the so-called "golf cart", which is small motorized vehicle that is now usually designed to carry two golfers and to provide a platform or rack at the rear for the bags.

While the practice of carrying the golf club bag on a golf cart is certainly convenient, it does present some problems. When a conventional golf club bag is carried on a golf cart, the small irons are positioned in such a way that it is difficult for the golfer to identify and select a suitable club when he dismounts from the cart and approaches his golf bag at the back of the cart. This difficulty is not only exasperating to the golfer, but also tends to slow down the play. These and other difficulties experienced with the prior art devices have been obviated in a novel manner by the present invention.

It is, therefore, an outstanding object of the invention to provide a golf club bag that, when carried on golf cart, facilitates the selection of a suitable club.

Another object of this invention is the provision of a golf club bag that has functional compartments that are arranged in such a way to be readily available when the bag is carried on a golf cart.

A further object of the present invention is the provision of a golf club bag that is aesthetically pleasing in appearance.

A still further object of the invention is the provision of a golf club bag which is simple and rugged in construction, which can be easily manufactured from inexpensive materials, and which is capable of a long life of useful service with a minimum of maintenance.

It is a further object of the invention to provide a golf bag that allows the clubs to be readily identified and facilitates the selection of a desired club, thus speeding up golf play.

With these and other objects in view, as will be apparent to those skilled in the art, the invention resides in the combination of parts set forth in the specification and covered by the claims appended hereto.

SUMMARY OF THE INVENTION

In general the present invention relates to a golf club bag for use on a golf cart, including a tubular main body, a base that is located at the lower end of the main body, and a cuff that is located at the upper end of the main body to define an opening. The cuff has an upper edge that slopes downwardly from the back of the bag to the front. A golf cart strap retainer is located on the upper portion of the main body on the back, a handle is located on the front of the main body adjacent the upper end, and rods extend transversely of the cuff to divide the opening into three sectors, including a long wood sector adjacent the back of the main body, a short iron sector adjacent the front of the main body, and an intermediate sector between the two above-named sectors.

More specifically, a golf ball compartment protrudes forwardly from the front of the main body a substantially greater distance than a utility compartment protrudes rearwardly from the back of the main body. No shoulder strap is provided. The utility compartment is formed with an elongated zipper opening on both sides, so that it is accessible from either side of the bag.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
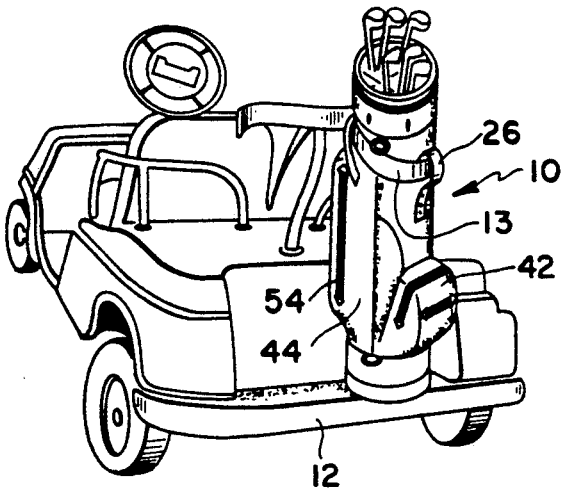
FIG. 1 is a perspective view of a golf club bag incorporating the principles of the present invention and shown in use mounted on a golf cart.

Referring first to FIG. 1, which best shows the general features of the invention, the golf club bag, indicated generally by the reference 10, is shown as mounted on the rear platform or rack of a golf cart 12. When the bag is so mounted, the bag is oriented with a handle 26 that is directed away from the rear of the cart and held in place by a conventional golf cart strap 13 looped through the handle.

Figure 2:
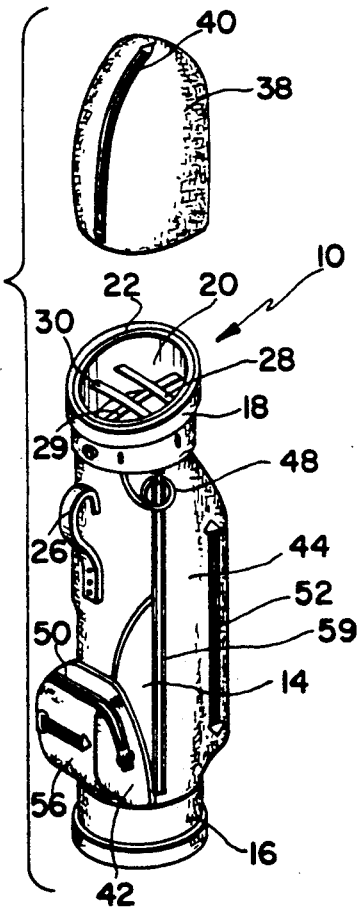
FIG. 2 is an exploded perspective view of the golf club bag and a hood for use therewith.

As is evident in FIG. 2, the golf club bag 10 includes a flexible tubular main body 14 with rigid metallic or plastic vertical supports 59 and a rigid base 16 located at the lower end of the main body. A rigid cuff !8 is located at the upper end of the main body and serves to define an opening 20 with a diameter A of approximately eight inches. The cuff has a generally circular upper edge 22 that slopes downwardly from a high point at the back of the bag to a low point at the front. A retainer 24 for the golf cart strap 13 is located on the upper portion of the main body at the back. As has been pointed out above, the handle 26 is located on the front of the main body adjacent the upper end, but no shoulder strap is provided. A hood 38 with a zippered opening 40 is provided for attachment to the upper edge 22 of the cuff.

Figure 3:
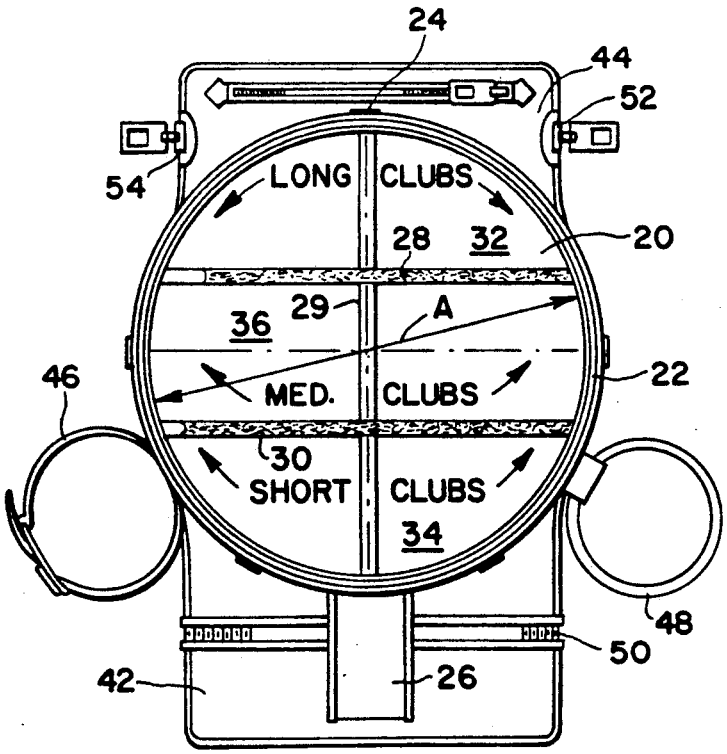
FIG. 3 is a plan view of the golf club bag.

As shown in FIG. 3, two rigid rods 28 and 30 extend transversely of the cuff to divide the opening 20 into three sectors, including a long wood sector 32 adjacent the back of the main body, a short iron sector 34 adjacent the front of the main body, and an intermediate sector 36 that is located between the two above-named sectors. A rigid rod 29 extends centrally of the opening 20 from front to back, thus dividing each sector into two parts. The rods 28, 29 and 30 are preferably covered with fleece sleeves as generally illustrated.

Figure 5:
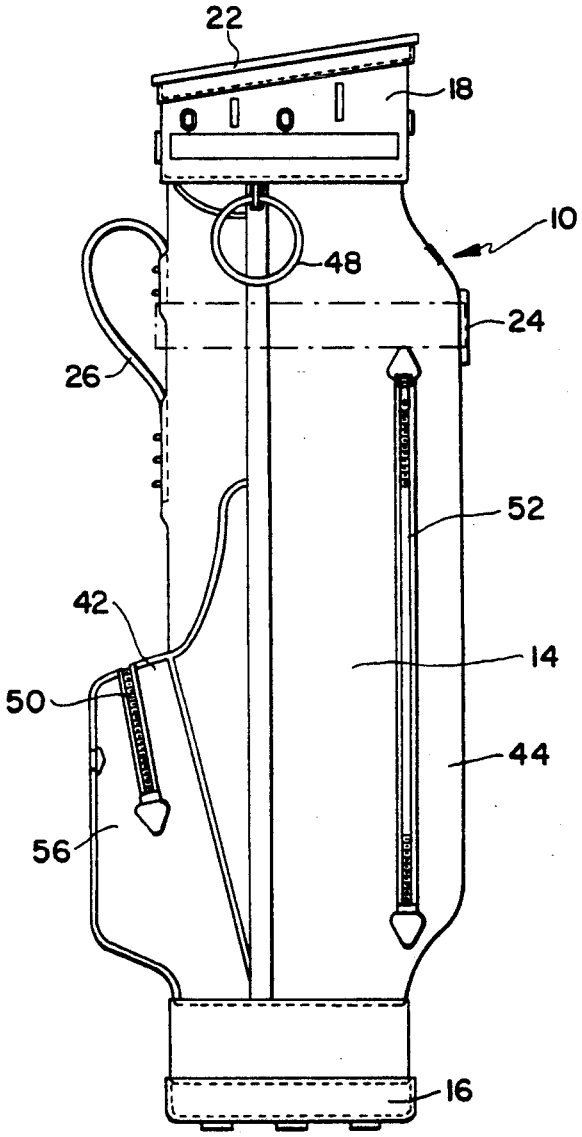
FIG. 5 is a front elevational view of the bag.
Figure 4:
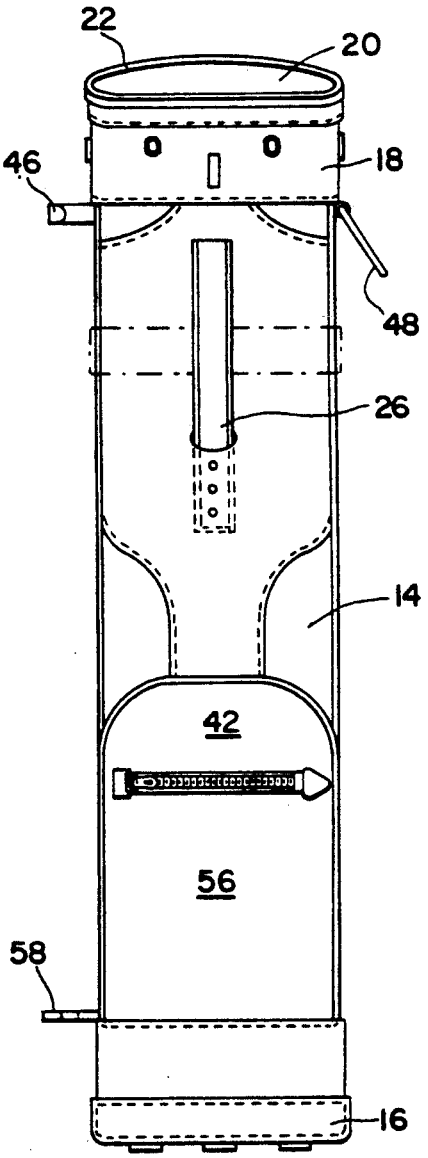
FIG. 4 is a side elevational view of the bag.

FIGS. 4 and 5 illustrate various features of the invention, including a relatively-large golf ball compartment 42 which is located on the front of the main body 14 adjacent the lower end. An elongated utility compartment 44 extends vertically along the back of the main body below the golf cart retainer 24.

In the preferred embodiment of the invention, the rods 28 and 30 are covered with a padding material, such as fleece that will not damage the clubs. An umbrella strap 46 is located at the upper part of the main body on one side thereof and a towel ring 48 is located at the upper part of the other side of the main body. Both the umbrella strap and towel ring are located so that when the bag is mounted upon the cart, both the umbrella and towel are readily accessible.

The golf ball compartment 42 and the utility compartment 44 are provided with zippered openings 50 and 52, respectively. As is evident in FIG. 2, the golf ball compartment 42 extends forwardly from the front of the main body a substantially greater distance than the utility compartment 44 extends rearwardly from the back of the main body. This arrangement is desirable, because the utility compartment is located at the back of the main body and is pressed against the body of the golf cart. An interesting aspect of the invention is that no shoulder strap is provided, as is usual in conventional golf club bags.

The utility compartment 44 is provided with an elongated zipper opening on each side, including the opening 52 and a second opening 54, so that the interior of the compartment is accessible from either side of the bag; this is particularly desirable when the bag is carried in the golf cart and an emergency arises. A small zippered tee compartment is mounted on the front surface of the golf ball compartment 42. An umbrella tip retainer 58 is mounted on the base 16 directly under the umbrella strap 46.

The materials used in the golf club bag may include leather or heavy duty vinyl trim and similar materials may be used in the handle, base, and cuff construction. The main body may be constructed of a relatively flexible material, such as leather, vinyl, or nylon. All the trim would be made of brass or stainless steel to prevent rust. All zippers would be constructed of heavy duty brass or nylon and, preferably, all the zippers would be of the locking type.

The operation of the invention will now be easily understood in light of the above description. When the golfer arrives at the golf course in an automobile, the bag with the clubs will usually be stored in the trunk of the automobile and can be lifted out by use of the handle 26. It is then placed in the platform or rack at the rear of the golf cart 12 by making use of the handle and is easily adjusted for proper orientation in the same manner. When placed in the rack, the front side of the bag with the handle 26 faces rearwardly of the cart. In that position, the important elements of the bag are accessible to the golfer when he faces the rear of the cart. For instance, the golf ball compartment 42, which is always rather bulky, faces outwardly and is readily available, along with the tee compartment 56. The handle 26 and the strap retainer 24 cooperate with the golf cart strap 13 to maintain the bag securely in place despite bumping and jarring during the round of play. In the event of a shower during the round, the interior of the utility compartment 44 is easily available from either side in order to have access to rain clothes, while the umbrella can be used also. A major advantage of the present invention, however, lies in the fact that the small irons are at the lower (rearward) position, where the selection can be made in a rapid manner.

The advantages of the invention will now be evident, particularly the ability to leave the seat of the golf cart and to identify and to make a selection of the proper clubs without difficulty. The shorter clubs are located in the sector 34 and, therefore, face the golfer in a convenient manner, while the longer clubs are located in the sector 32 that is located further from the golfer at the back or cart side of the golf bag. This allows the clubs to be easily identified by the golfer and tends to speed up the golf play; this avoids holding up a following group of golfers. When the weather changes, the utility compartment is easily available to take out clothing or to rapidly store a jacket, etc., that is no longer needed. At the same time, the compartments containing the golf balls and tees, which are almost always needed, are at the outermost part of the cart and bag. It is not necessary to re-orientate or remove the golf bag from the cart to gain access to any of the compartments.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to be secured by Letter Patent is:

1. Golf club bag for use on a golf cart having a platform and a flexible strap affixed above the platform, comprising:

(a) a tubular main body having rigid vertical supports extending substantially the length of the body, (b) a base located at the lower end of the main body, (c) a cuff located at the upper end of the main body to define an opening, the cuff having an upper edge that slopes downwardly from the back of the bag to the front, (d) a golf cart strap retainer located on the upper portion of the main body on the back, (e) a handle located and attached on the front of the main body adjacent the upper end, (f) rods extending transversely of the cuff to divide the opening into three sectors, including a long wood sector adjacent the back of the main body, a short iron sector adjacent the front of the main body, and an intermediate sector between the two above-named sectors, (g) a golf ball compartment located on the front of the main body adjacent the lower end, and (h) an elongated utility compartment extending vertically along the back of the main body under the golf cart strap retainer and having an elongated zipper opening on each side so that it is accessible from either side of the bag, said flexible strap passing through the handle to fasten the bag on the cart, the cuff of the bag being at a lower elevation when attached at the rear of the cart to provide ease of selection of irons.

2. Golf club bag as recited in claim 1, wherein the rods are covered with a padding material, wherein an umbrella strap is located at the upper part of the main body on one side thereof, and wherein a towel ring is located at the upper part on the other side of the main body.

3. Golf club bag as recited in claim 2, wherein a zippered tee compartment is mounted on the front surface of the golf ball compartment, and wherein an umbrella tip retainer is mounted on the base directly under the umbrella strap.

4. Golf club bag as recited in claim 1, wherein the golf ball and utility compartments are provided with zippered openings.

5. Golf club bag as recited in claim 4, wherein the golf ball compartment extends forwardly from the front of the main body a substantially greater distance than the utility compartment extends rearwardly from the back of the main body.

* * * * *